US010128611B2

(12) United States Patent
Rhein et al.

(10) Patent No.: US 10,128,611 B2
(45) Date of Patent: Nov. 13, 2018

(54) FERRULE ASSEMBLY FOR AN ELECTRICAL CONNECTOR

(71) Applicant: TE CONNECTIVITY CORPORATION, Berwyn, PA (US)

(72) Inventors: David James Rhein, Memphis, MI (US); Aric J. Boyer, Troy, MI (US); Thomas Robert DeWitte, Shelby Township, MI (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/661,876

(22) Filed: Jul. 27, 2017

(65) Prior Publication Data

US 2018/0034200 A1 Feb. 1, 2018

Related U.S. Application Data

(60) Provisional application No. 62/369,481, filed on Aug. 1, 2016.

(51) Int. Cl.

| | |
|---|---|
| ***H01R 4/66*** | (2006.01) |
| ***H01R 13/58*** | (2006.01) |
| ***H01R 9/05*** | (2006.01) |

(52) U.S. Cl.

CPC ..... *H01R 13/5804* (2013.01); *H01R 9/0518* (2013.01); *H01R 13/5808* (2013.01)

(58) Field of Classification Search

CPC .. H01R 13/658; H01R 13/516; H01R 9/0518; H01R 9/032; H01R 4/64; H01R 4/646

USPC ..... 439/585, 98, 607.5, 607.51

See application file for complete search history.

(56) References Cited

U.S. PATENT DOCUMENTS

| | | | | |
|---|---|---|---|---|
| 3,297,979 A * | 1/1967 | O'Keefe | H01R 9/0518 | 439/585 |
| 3,740,453 A | 6/1973 | Callaghan et al. | | |
| 4,469,390 A | 9/1984 | LeVine et al. | | |
| 4,613,199 A * | 9/1986 | McGeary | H01R 9/0518 | 439/585 |
| 5,368,505 A * | 11/1994 | Hoolhorst | H01R 9/032 | 439/470 |

(Continued)

FOREIGN PATENT DOCUMENTS

| | | |
|---|---|---|
| EP | 0027680 A1 | 4/1981 |
| EP | 0694989 A2 | 1/1996 |

OTHER PUBLICATIONS

International Search Report, International Application No. PCT/IB2017/054634, International Filing Date Jul. 28, 2017.

*Primary Examiner* — Hien Vu

(57) ABSTRACT

A ferrule assembly for terminating an electrical connector to a cable includes an inner ferrule, an outer ferrule and an inner ferrule sleeve. The inner ferrule has an inner surface and an outer surface. The inner ferrule is conductive and provides electrical shielding. The outer ferrule is positioned radially outside of the inner ferrule such that a cable shield of the cable is received between the inner ferrule and the outer ferrule. The outer ferrule secures the cable shield between the inner ferrule and the outer ferrule. The inner ferrule sleeve is positioned radially inside of the inner ferrule. The inner ferrule sleeve substantially fills the space between the inner ferrule and an inner jacket of the cable. The inner ferrule sleeve is dielectric and electrically isolating the inner ferrule from an inner conductor of the cable.

20 Claims, 4 Drawing Sheets

(56) References Cited

U.S. PATENT DOCUMENTS 5,691,506 A * 11/1997 Miyazaki ..... H01R 4/646
174/652
6,152,746 A * 11/2000 Brown ..... H01R 9/0518
439/99

* cited by examiner

FERRULE ASSEMBLY FOR AN ELECTRICAL CONNECTOR

CROSS-REFERENCE TO RELATED APPLICATIONS

This application claims the benefit of U.S. Provisional Application No. 62/369,481, filed Aug. 1, 2016, titled "FERRULE ASSEMBLY FOR AN ELECTRICAL CONNECTOR", the subject matter of which is herein incorporated by reference in its entirety.

BACKGROUND OF THE INVENTION

The subject matter herein relates generally to ferrule assemblies for terminating shielded electrical connectors to ends of cables.

Known electrical connectors are terminated to ends of cables. Typically, a ferrule is provided at the end of the housing of the electrical connector to provide strain relief for the cable. Some known electrical connectors electrically connect a shield of the electrical connector with the cable shield of the cable. However, some known cables use braided cable shields that have conductive strands braided together to form the cable shield. The strands are susceptible to coming within a short distance with or even contact with the inner conductor of the cable or the terminal of the electrical connector within the housing. Such situation may lead to electrical shorting of the cable braid to the conductor.

Some known connectors route the cable shield to an exterior surface of the ferrule. However, a gap may still exist between the interior surface of the ferrule and the inner jacket of the cable. Some of the strands may inadvertently be loaded into the interior of the ferrule in the gap, such as during assembly of the ferrule to the cable. The strands that pass through the gap may short circuit the cable braid to the inner conductor.

A need remains for a ferrule assembly for terminating shielded electrical connectors to ends of cables that avoid short circuiting of the cable braid to the inner conductor.

BRIEF DESCRIPTION OF THE INVENTION

In one embodiment, a ferrule assembly for terminating an electrical connector to a cable is provided including an inner ferrule, an outer ferrule and an inner ferrule sleeve. The inner ferrule has an inner surface and an outer surface. The inner ferrule is conductive and provides electrical shielding. The outer ferrule is positioned radially outside of the inner ferrule such that a cable shield of the cable is received between the inner ferrule and the outer ferrule. The outer ferrule secures the cable shield between the inner ferrule and the outer ferrule. The inner ferrule sleeve is positioned radially inside of the inner ferrule. The inner ferrule sleeve substantially fills the space between the inner ferrule and an inner jacket of the cable. The inner ferrule sleeve is dielectric and electrically isolating the inner ferrule from an inner conductor of the cable.

In another embodiment, an electrical connector is provided including a housing having a mating end configured to be mated with a mating connector and a cable end configured to be terminated to an end of a cable. A ferrule assembly is provided at the cable end and is configured to be coupled to the cable. The ferrule assembly includes an inner ferrule, an inner ferrule sleeve inside the inner ferrule and an outer ferrule outside of the inner ferrule. The inner ferrule is conductive and provides electrical shielding. The inner ferrule has an inner surface and an outer surface with the outer ferrule positioned radially outside of the inner ferrule such that a cable shield of the cable is received between the inner ferrule and the outer ferrule. The outer ferrule secures the cable shield between the inner ferrule and the outer ferrule. The inner ferrule sleeve substantially fills the space between the inner ferrule and an inner jacket of the cable. The inner ferrule sleeve is dielectric and electrically isolates the inner ferrule from an inner conductor of the cable.

In a further embodiment, an electrical connector is provided including a cable having an end with an inner conductor, an inner jacket surrounding the inner conductor, a cable shield surrounding the inner jacket and a cable jacket surrounding the cable shield. The electrical connector includes a housing having a mating end configured to be mated with a mating connector and a cable end terminated to the end of the cable. The housing holds a terminal terminated to the inner conductor. The housing has a shield electrically connected to the cable shield. A ferrule assembly is provided at the cable end for coupling the shield to the cable shield of the cable. The ferrule assembly includes an inner ferrule, an inner ferrule sleeve inside the inner ferrule and an outer ferrule outside of the inner ferrule. The inner ferrule is conductive and is electrically connected to the shield to provide electrical shielding. The inner ferrule has an inner surface and an outer surface with the outer ferrule positioned radially outside of the inner ferrule such that the cable shield of the cable is received between the inner ferrule and the outer ferrule. The outer ferrule secures the cable shield between the inner ferrule and the outer ferrule. The inner ferrule sleeve substantially fills the space between the inner ferrule and the inner jacket of the cable. The inner ferrule sleeve is dielectric and electrically isolates the inner ferrule from the inner conductor of the cable.

DETAILED DESCRIPTION OF THE INVENTION

Figure 1:
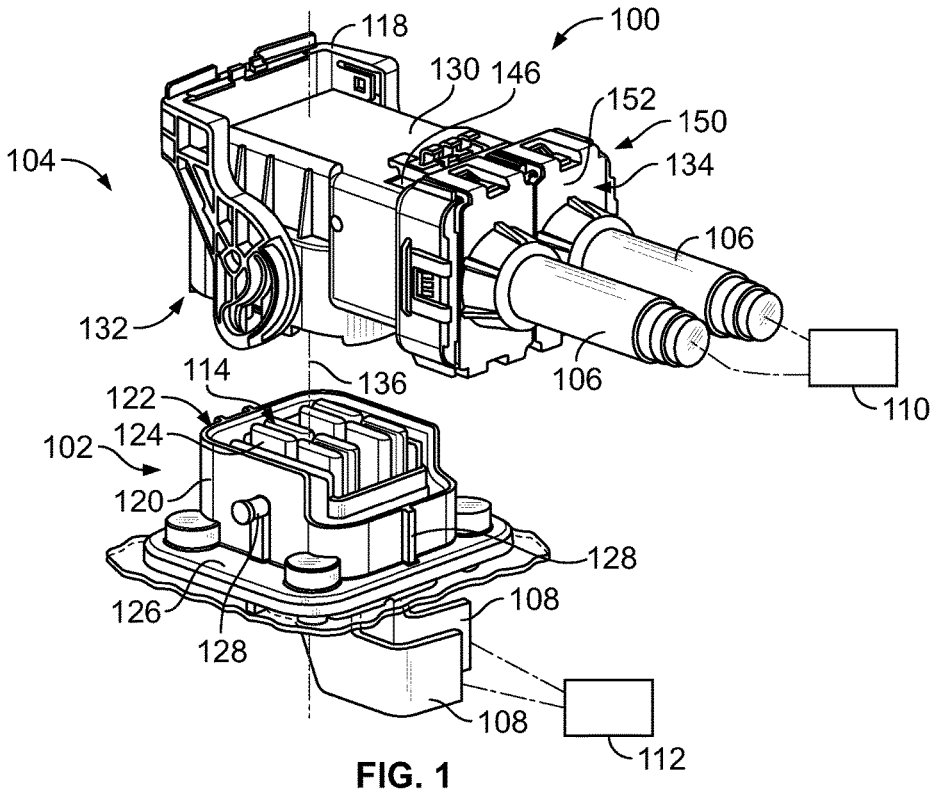
FIG. 1 is a perspective view of a power connector system including electrical connectors formed in accordance with an exemplary embodiment.

FIG. 1 is a perspective view of a power connector system 100 including electrical connectors 102, 104 formed in accordance with an exemplary embodiment. In an exemplary embodiment, the electrical connectors 102, 104 of the power connector system 100 are a header connector 102 and a plug connector 104 configured to be mated with the header connector 102. The plug connector 104 is shown poised for mating with the header connector 102. In an exemplary embodiment, the power connector system 100 is a high power connector system that is used to transfer power between various components as part of a high power circuit. In a particular application, the power connector system 100 is a battery system, such as a battery system of a vehicle, such as an electric vehicle or hybrid electric vehicle; however the power connector system 100 is not intended to be limited to such battery systems.

The plug connector 104 is configured to be electrically connected to a component 110, such as through one or more cables 106. The cables 106 may be power cables 106 configured to convey power. For example, the plug connector 104 may be electrically connected to a battery, a charger, an inverter, an electric motor or another type of component. The header connector 102 is configured to be electrically connected to a component 112, such as through a power bus 108; however the header connector 102 may be electrically connected to the component 112 by other means, such as a terminal, power wire or other connector. For example, the header connector 102 may be electrically connected to a battery pack, such as through a battery distribution unit, a manual service disconnect, a charger, an inverter, an electric motor, or another type of component. The battery distribution unit may manage the power capacity and functionality of the power connector system 100, such as by measuring current and regulating power distribution of the battery pack.

The power connector system 100 is a right angle connector system where the connectors 102, 104 are mated in a direction perpendicular to the power wires. Optionally, the plug connector 104 may be removably coupled to the header connector 102 to disconnect the high power circuit of one or more of the components, such as the battery pack, the electric motor, the inverter, or other components of the vehicle, such as for maintenance, repair or for another reason. When mated, one or more header terminals 114 of the header connector 102 are mated with corresponding plug terminals 116 (shown in FIG. 2) of the plug connector 104, such as at mating interfaces thereof. Having a greater number of terminals 114 and/or 116 increases the current carrying capacity of the system 100. Optionally, each plug terminal 116 may be terminated to a corresponding power cable 106.

In an exemplary embodiment, the header connector 102 and/or the plug connector 104 may include a high voltage interlock (HVIL) circuit to control the high voltage power circuit during opening and closing or mating and unmating of the connectors 102, 104. For example, both connectors 102, 104 may include corresponding HVIL terminals. The HVIL circuit may be electrically connected to the component 112 and/or the component 110. In an exemplary embodiment, the plug connector 104 utilizes a lever 118 to unmate and/or mate the connectors 102, 104, which may open/close the high voltage circuit and the HVIL circuit during unmating/mating of the connectors 102, 104. The HVIL circuit may be opened first during unmating to shut of the high voltage circuit prior to opening or unmating of the terminals 116, 114, which may reduce the likelihood of damage, such as from arcing. In an exemplary embodiment, the high voltage conducting surfaces of the connectors 102, 104 are finger proof and touch safe.

The header connector 102 includes a header housing 120 having a mating end 122. The header housing 120 holds one or more of the header terminals 114. Optionally, the header terminals 114 may be fork terminals having sockets defined by spring beams on both sides of the sockets to mate with both sides of the plug terminal 116, as described in further detail below; however, other types of header terminals may be used in alternative embodiments. The header terminals 114 may be shrouded to protect the header terminals 114. For example, the header terminals 114 may have covers or touch guards 124 such that the header terminals 114 are touch safe. The header housing 120 includes a flange 126 for mounting the header housing 120 to another component, such as a chassis or other supporting structure. Optionally, the header housing 120 may be mounted horizontally; however, other orientations are possible in alternative embodiments. In an exemplary embodiment, the header housing 120 includes guide features 128 for guiding mating of the electrical connector 104 with the header connector 102. For example, the guide features 128 may be ribs, posts, slots, keying features or other types of guide features.

The plug connector 104 includes a plug housing 130 configured to be coupled to the header housing 120. The plug housing 130 includes a mating end 132 and a cable end 134. The power cables 106 extend from the cable end 134. The mating end 132 is mated to the mating end 122 of the header housing 120. In an exemplary embodiment, the housing 130 is a right angle housing holding the power cables 106 and the power terminals 116 perpendicular to a mating direction along a mating axis 136. The power cables 106 are at a right angle with respect to the mating axis 136. Other orientations are possible in alternative embodiments.

In an exemplary embodiment, the lever 118 is rotatably coupled to the housing 130. The lever 118 is configured to engage the header housing 120, such as corresponding guide features 128, to secure the plug connector 104 to the header connector 102. Optionally, the lever 118 may include a slot that receives corresponding guide features 128 to control mating and unmating of the plug connector 104 to the header connector 102. For example, as the lever 118 is rotated closed, the housing 130 may be pulled down onto the header housing 120. Conversely, as the lever 118 is raised, the housing 130 may be pressed away from and unmated from the header housing 120. The high power circuit and the HVIL circuit of the power connector system 100 may be opened and closed as the plug connector 104 is unmated from and mated to the header connector 102.

The plug connector 104 includes a shield 146 (only a portion is shown in FIG. 1, the shield 146 being provided interior of the housing 130) to provide electrical shielding for the plug connector 104. The shield 146 surrounds the plug terminals 116 to provide electrical shielding for the plug terminals 116. The shield 146 is configured to be electrically connected to shielding of the power cables 106. The shield 146 may be configured to be electrically connected to the header connector 102.

In an exemplary embodiment, the plug connector 104 includes a ferrule assembly 150 at the cable end 134. The ferrule assembly 150 is used for terminating the plug connector 104 to the power cable 106. The ferrule assembly 150 may be mechanically and/or electrically connected to the power cable 106. For example, the ferrule assembly 150 may be electrically connected to a cable shield of the cable 106. The ferrule assembly 150 may be mechanically connected to the cable 106 by an interference or friction fit. The ferrule assembly 150 may be mechanically connected to the cable 106 by a crimp connection. The ferrule assembly 150 may be connected to and/or form part of the plug housing 130. For example, the ferrule assembly 150 may include an end cap 152 secured to the cable end 134 of the plug housing 130. The end cap 152 may be secured by latches, fasteners or other securing features. The ferrule assembly 150 may include part of and/or be electrically connected to the shield 146.

Figure 2:
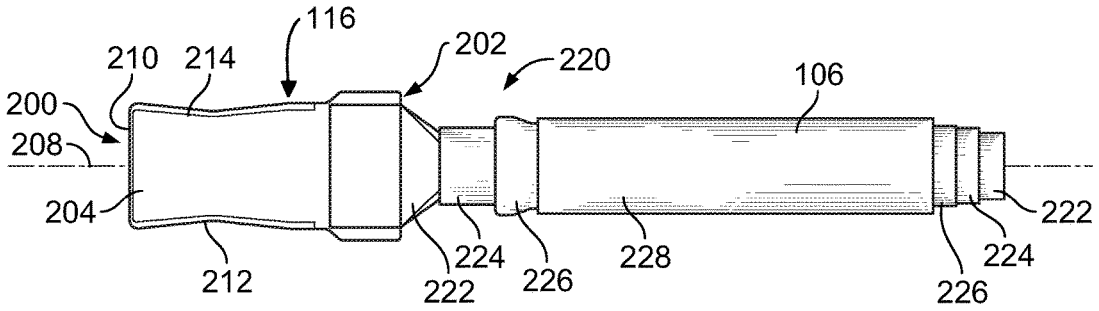
FIG. 2 is a perspective view of a portion of the power connector system showing a plug terminal terminated to a power cable.

FIG. 2 is a perspective view of a portion of the power connector system 100 showing the plug terminal 116 terminated to the power cable 106. In an exemplary embodiment, the plug terminal 116 is welded to the power cable 106. The plug terminal 116 may be terminated to the power cable 106 by other means in an alternative embodiment, such as crimping. In the illustrated embodiment, the plug terminal 116 is a tab terminal and may be referred to hereinafter as a tab terminal 116. The tab terminal 116 is generally planar and extends between a mating end 200 and a cable end 202.

The tab terminal 116 includes sides 204 extending along a longitudinal axis 208 between a tip 210 of the tab terminal 116 and the cable end 202. The tab terminal 116 includes a leading edge 212 and a trailing edge 214 at the bottom and top, respectively, of the tab terminal 116. The leading edge 212 is the edge of the tab terminal 116 that is configured to be plugged into the header terminals 114.

The tab terminal 116 is terminated to an end 220 of the cable 106. The cable 106 includes an inner conductor 222 electrically connected to the tab terminal 106. In an exemplary embodiment, the inner conductor 222 includes a stranded core having a plurality of conductive strands configured to be welded or crimped to the cable end 202 of the tab terminal 116. The cable 106 includes an inner jacket 224 surrounding the inner conductor 222. The inner jacket 224 is manufactured from a dielectric material and is used to contain the stands of the inner conductor 222 and electrically isolate the inner conductor 222. The cable 106 includes a cable shield 226 surrounding the inner jacket 224 and a cable jacket 228 surrounding the cable shield 226. The cable shield 226 provides electrical shielding for the inner conductor 222. In an exemplary embodiment, the cable shield 226 is a stranded, braided cable shield 226. In an exemplary embodiment, the cable jacket 228 is an outer jacket of the cable 106. The cable 106 may have other layers in alternative embodiments. In other various embodiments, rather than having a stranded inner conductor, the cable 106 may include one or more twisted pairs of wires in the core.

Figure 3:
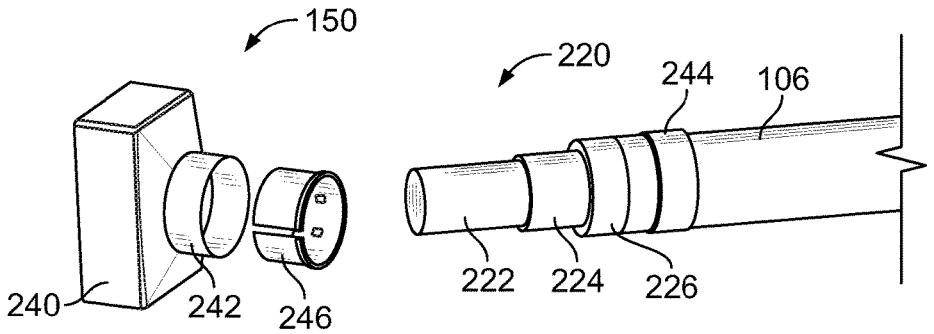
FIG. 3 is a perspective view of the power cable and a portion of a ferrule assembly in accordance with an exemplary embodiment.

FIG. 3 is a perspective view of the power cable 106 and a portion of the ferrule assembly 150 in accordance with an exemplary embodiment. The ferrule assembly 150 includes an end shield 240, which may be part of, or be electrically connected to, the electrical shield 146 (shown in FIG. 1). The end shield 240 extends to an inner ferrule 242 at a terminating end thereof. The ferrule assembly 150 includes an outer ferrule 244 configured to be positioned radially outside of the inner ferrule 242 and an inner ferrule sleeve 246 configured to be positioned radially inside of the inner ferrule 242.

The outer ferrule 244 is configured to be slipped over the end 220 of the cable 106 prior to connecting the end shield 240 to the end 220 of the cable 106. The outer ferrule 244 is used to crimp the ferrule assembly 150 to the cable 106.

The inner ferrule sleeve 246 is used to protect the cable 106. For example, the inner ferrule sleeve 246 protects the inner jacket 224 from the inner ferrule 242. The inner ferrule sleeve 246 protects the inner conductor 222 from the cable shield 226, as described in further detail below.

Figure 4:
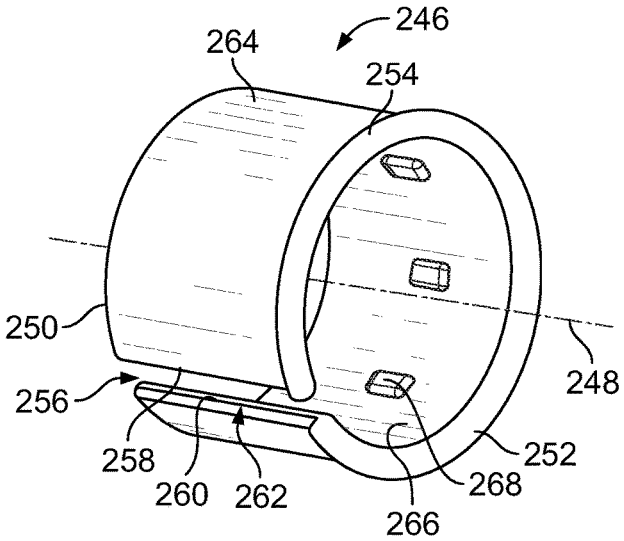
FIG. 4 is perspective view of an inner ferrule sleeve of the ferrule assembly in accordance with an exemplary embodiment.

FIG. 4 is perspective view of the inner ferrule sleeve 246 in accordance with an exemplary embodiment. The sleeve 246 is generally cylindrical shaped extending along a longitudinal axis 248 between a front 250 and a rear 252. The sleeve 246 includes a lip 254 at the rear 252. The lip 254 is used to position the sleeve 246 in the inner ferrule 242 (shown in FIG. 3).

The sleeve 246 includes a seam 256 extending lengthwise along the sleeve 246 between the front 250 and the rear 252. The seam 256 allows the sleeve 246 to change diameter to fit in the inner ferrule 242. For example, the sleeve 246 includes edges 258, 260 facing each other across the seam 256. In the normal or resting position, the edges 258, 260 are spaced apart from each other defining a gap 262 therebetween. The sleeve 246 may be compressed by pressing the edges 258, 260 together at the seam 256, such as until the edges 258, 260 engage each other. As the sleeve 246 is compressed, the diameter of the sleeve 246 changes, such as to fit in the inner ferrule 242. After being compressed, the sleeve 246 may have an internal spring bias biasing the sleeve 246 outward to return to the normal or resting position. After the sleeve 246 is positioned in the inner ferrule 242, the internal biasing force may be used to press and hold the sleeve 246 against the inner ferrule 242 when installed therein.

In an exemplary embodiment, the sleeve 246 includes an outer surface 264 configured to engage the inner ferrule 242 and an inner surface 266 opposite the outer surface 264. The inner surface 266 is configured to engage the inner jacket 224 (shown in FIG. 3).

In an exemplary embodiment, the sleeve 246 includes interference bumps 268 extending inward from the inner surface 266. The interference bumps 268 are configured to embed into the inner jacket 224 to secure the inner ferrule sleeve 246 to the cable 106. Any number of interference bumps 268 may be provided. The interference bumps 268 may have any size or shape depending on the embodiment. In the illustrated embodiment, the interference bumps 268 are generally rectangular having a flat inner surface and rounded edges or corners. The interference bumps 268 may be knurled or have grooves or slots therein to increase the friction or holding force between the sleeve 246 and the cable 106. In the illustrated embodiment, each of the interference bumps 268 are positioned at the same depth from the front 250; however, the interference bumps 268 may be axially offset around the inner surface 266 in alternative embodiments.

Figure 5:
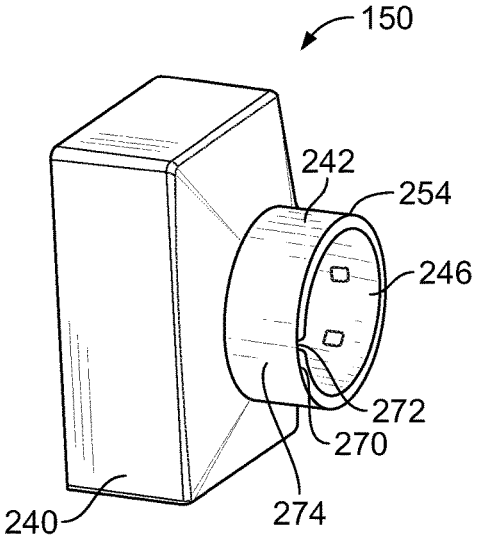
FIG. 5 is a perspective view of a portion of the ferrule assembly showing the inner ferrule sleeve received in an inner ferrule.

FIG. 5 is a perspective view of a portion of the ferrule assembly 150 showing the inner ferrule sleeve 246 received in the inner ferrule 242. The sleeve 246 may be loaded into the inner ferrule 242 from behind the end shield 240. The sleeve 246 may be compressed to fit in the inner ferrule 242. The sleeve 246 may be loaded into the inner ferrule 242 until the lip 254 engages a rear edge 270 of the inner ferrule 242. The sleeve 246 is received in the inner ferrule 242 such that the outer surface 264 of the sleeve 246 engages an inner surface 272 of the inner ferrule 242. The inner surface 272 is located opposite an outer surface 274 of the inner ferrule 242.

In the illustrated embodiment, the inner ferrule 242 is cylindrical shaped; however, the inner ferrule 242 may have other shapes in alternative embodiments. When the sleeve 246 is received in the inner ferrule 242, the sleeve 246 lines the inner surface 272 of the inner ferrule 242. The sleeve 246 may be spring biased against the inner ferrule 242 to hold the sleeve 246 in the inner ferrule 242 by an interference fit. The lip 254 covers the rear edge 270. As such, no portion of the inner ferrule 242 is exposed within the interior cable channel of the inner sleeve 242 that receives the cable 106. The sleeve 246 isolates the cable 106 from the inner ferrule 242. The sleeve 246 may protect the cable 106 from touching the inner ferrule 242, which otherwise could cut or damage the cable 106 and/or may electrically short to the inner ferrule 242 when no sleeve is present.

Figure 6:
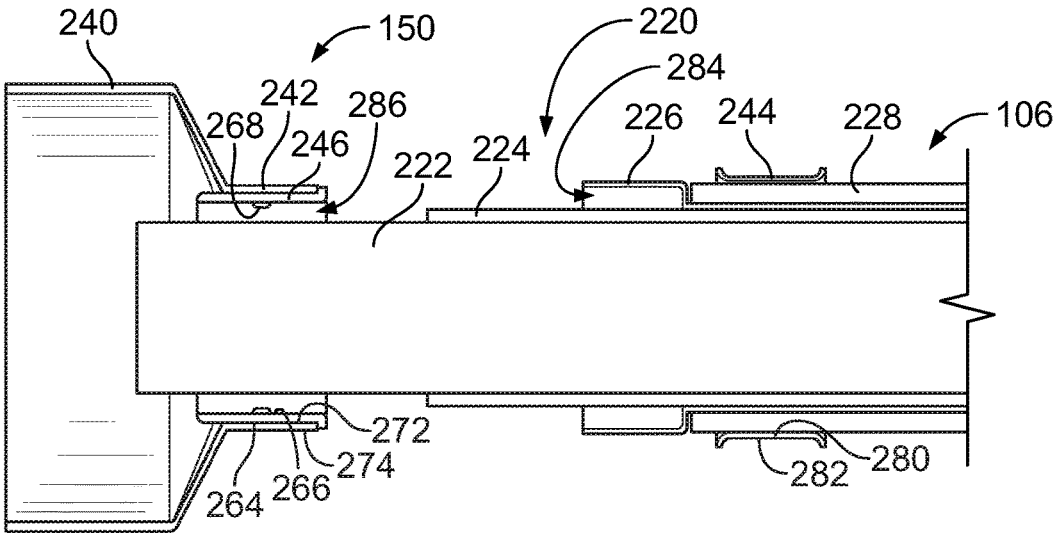
FIG. 6 is a cross-sectional view of the ferrule assembly and the power cable in a partially assembled state.
Figure 7:
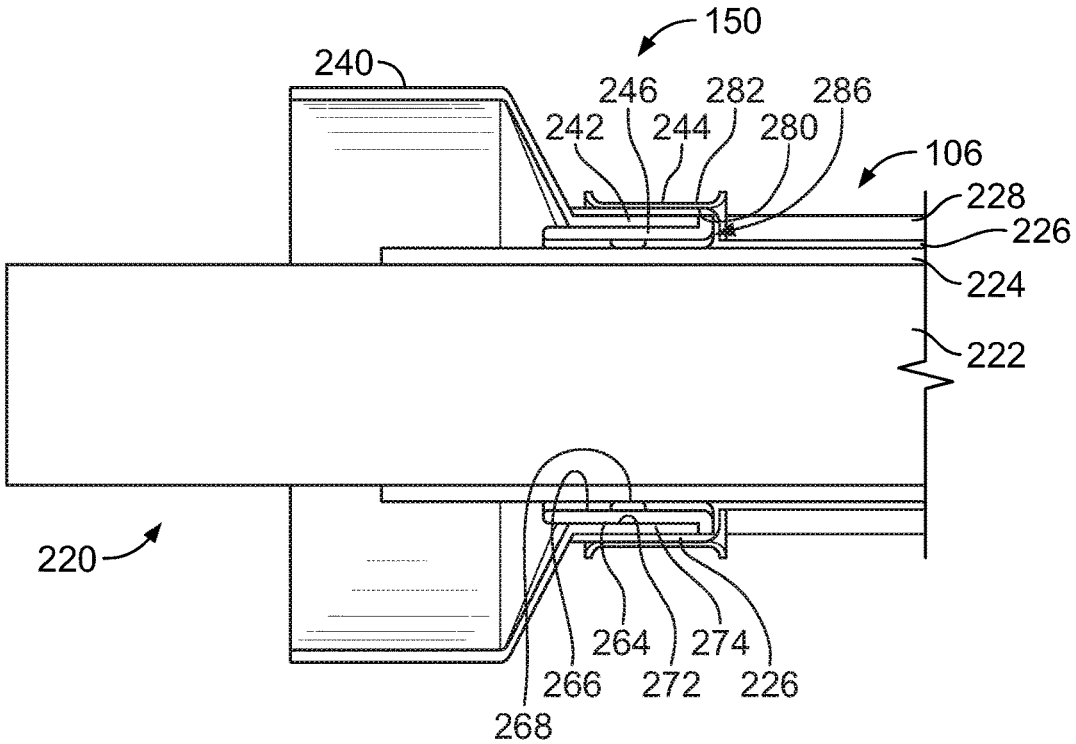
FIG. 7 is a cross-sectional view of the ferrule assembly and the power cable in an assembled state.
Figure 8:
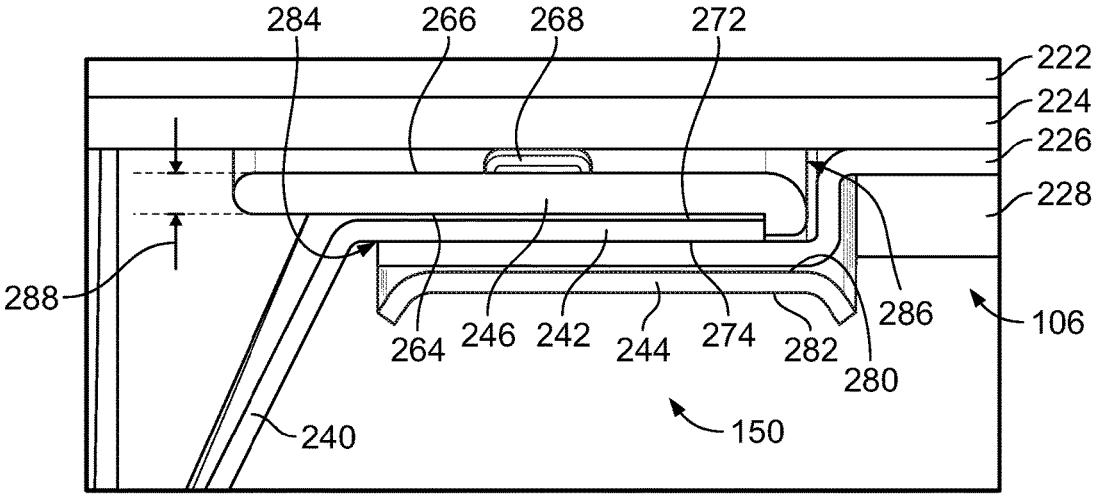
FIG. 8 is a cross-sectional view of a portion of the ferrule assembly and the power cable in an assembled state.

FIG. 6 is a cross-sectional view of the ferrule assembly 150 and the power cable 106 in a partially assembled state. FIG. 7 is a cross-sectional view of the ferrule assembly 150 and the power cable 106 in an assembled state. FIG. 8 is a cross-sectional view of a portion of the ferrule assembly 150 and the power cable 106 in the assembled state showing an enlarged view of the ferrule assembly 150 coupled to the power cable 106.

During assembly, the outer ferrule 244 is loaded onto the end 220 of the cable 106. The outer ferrule 244 includes an inner surface 280 facing the cable 106 and an outer surface 282 opposite the inner surface 280. The outer ferrule 244 has an inner diameter larger than an outer diameter of the cable 106 to allow the outer ferrule 244 to be loaded over the end 220 of the cable 106.

The end 220 of the cable 106 is cut to length and stripped to prepare the cable 106 for termination to the ferrule assembly 150. For example, a length of the cable jacket 228 is removed to expose the cable shield 226. Additionally, a length of the inner jacket 224 is removed to expose a portion of the inner conductor 222. The exposed end of the inner conductor 222 is configured to be terminated to the tab terminal 116 (shown in FIG. 2). For example, when assembled, the tab terminal 116 is terminated to the end 220 of the cable 106, and the ferrule assembly 150 is located on the cable 106 at a spaced apart location from the end 220 and the tab terminal 116. An exposed end of the cable shield 226 may be flared outward, such as using a mandrel, and cut to length. When the end of the cable shield 226 is flared outward, a gap 284 is defined between the interior of the cable shield 226 and the exterior of the inner jacket 224.

During assembly, the inner ferrule 242 and the inner ferrule sleeve 246 are loaded onto the end 220 of the cable 106. The inner ferrule 242 and the inner ferrule sleeve 246 are configured to be received in the gap 284. The end 220 of the cable 106 passes through the interior cable bore of the inner ferrule 242 and the sleeve 246. The inner ferrule 242 is loaded into the gap 284 such that the inner ferrule sleeve 246 and the inner ferrule 242 are positioned between the cable shield 226 and the inner jacket 224 (shown in FIG. 7). When assembled, the cable shield 226 extends along the outer surface 274 of the inner ferrule 242.

After the inner ferrule 242 and the sleeve 246 are positioned along the cable 106 in the gap 284, the outer ferrule 244 may be slid forward over the cable shield 226 and the inner ferrule 242. The outer ferrule 244 is moved such that the outer ferrule 244 is generally axially aligned with the inner ferrule 242 with the cable shield 226 being positioned radially between the inner ferrule 242 and the outer ferrule 244. The inner ferrule 242 is electrically conductive and the inner ferrule 242 is electrically connected to the cable shield 226 when the cable shield 226 directly engages the outer surface 274 of the inner ferrule 242. In an exemplary embodiment, the outer ferrule 244 is crimped around the cable shield 226 and the inner ferrule 242. For example, in an exemplary embodiment, the outer ferrule 244 may be hex-crimped around the inner ferrule 242.

In an exemplary embodiment, the inner ferrule sleeve 246 substantially fills a space 286 defined between the inner ferrule 242 and the inner jacket 224 of the cable 106. For example, the outer surface 264 of the inner ferrule sleeve 246 may be pressed against the inner surface 272 of the inner ferrule 242. The inner surface 266 of the sleeve 246 may face the inner jacket 224. The interference bumps 268 may engage the inner jacket 224. Optionally, the inner jacket 224 may engage the inner surface 266 of the sleeve 246.

By substantially filling the space 286, the sleeve 246 ensures that none of the strands of the cable shield 226 may pass into the interior of the inner ferrule 242. For example, any straggling strands from the cable shield 226 in the space 286 when the cable 106 is loaded into the inner ferrule 242 may be plowed rearward or outward by the inner ferrule sleeve 246. As such, none of the strands may inadvertently extend into the inner ferrules 242 and/or the end shield 240 where such strands could potentially short to the inner conductor 222.

In an exemplary embodiment, the cable shield 226 is wrapped around the outer surface 274 of the inner ferrule 242 to avoid having the strands of the cable shields 226 extend within the end shield 240 beyond the inner jacket 224 to touch the inner conductor 222, which would potentially short out the power cable 106. The inner ferrule sleeve 246 fills the space 286 to avoid inadvertently shorting out the cable 106.

In an exemplary embodiment, a thickness 288 (shown in FIG. 8) of the inner ferrule sleeve 246 defined between the outer surface 264 and the inner surface 266 may be selected to substantially fill the space 286. For example, a family of inner ferrule sleeves 246 may be provided having different thicknesses 288 to be used with different diameter cables 106 and/or different diameter inner ferrules 242. By utilizing inner ferrule sleeves 246 having different thicknesses, the same end shield 240 and inner ferrule 242 may be used with various different diameter cables 106 without having to redesign or retool the inner ferrule 242, which could add to manufacturing costs. The family of inner ferrule sleeves 246 may be rather easily manufactured by using molds having different thickness to provide the different thickness inner ferrule sleeved 246. As such, the overall cost of manufacturing this system may be reduced.

Figure 9:
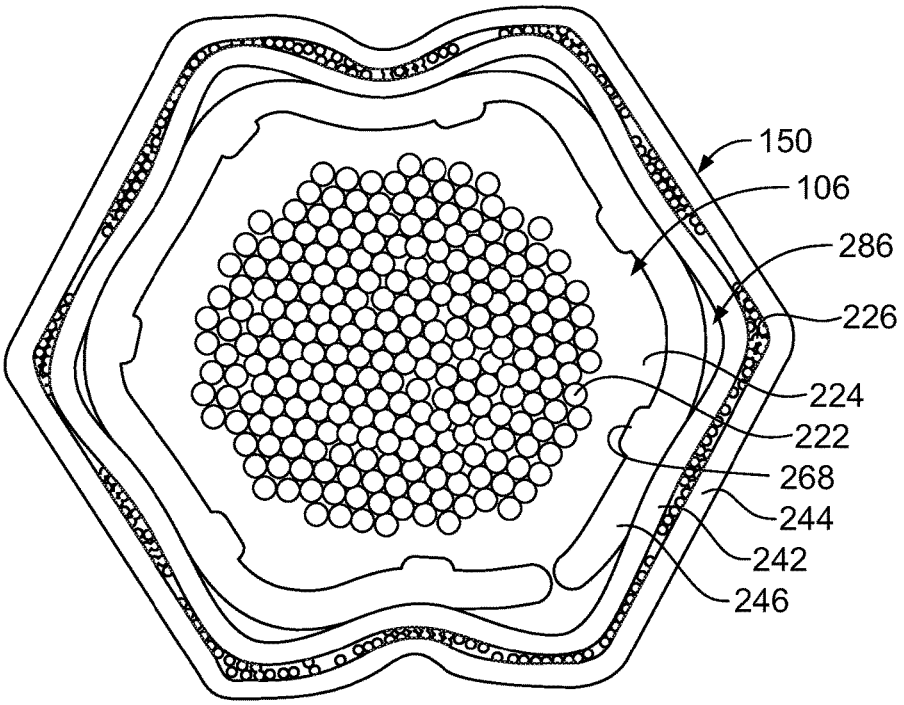
FIG. 9 is a cross-sectional view of a portion of the ferrule assembly terminated to the power cable.

FIG. 9 is a cross-sectional view of a portion of the ferrule assembly 150 terminated to the power cable 106. FIG. 9 illustrates the inner conductor 222 and inner jacket 224 interior of and surrounded by the inner ferule sleeve 246. The inner ferrule 242 surrounds the inner ferrule sleeve 246. The cable shield 226 is shown terminated between the inner ferrule 242 and the outer ferrule 244. The outer ferrule 244 is shown crimped around the inner ferrule 242 and the cable 106. The inner ferule sleeve 246 is shown substantially filling the space 286 between the inner ferrule 242 and the inner jacket 224. The interference bumps 268 are shown digging into and/or embedded in the inner jacket 224, which may help axially and/or rotatably secure the ferrule assembly 150 to the cable 106. FIG. 9 illustrates the individual strands of the cable shield 226 between the inner ferrule 242 and the outer ferrule 244. None of the strands of the cable shield 226 are located in the space 286 because the inner ferrule sleeve 246 substantially fills and/or block the space 286 such that none of the strands of the cable shield 226 inadvertently pass into the interior of the inner ferrule 242 to potentially short out to the inner conductor 222.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A ferrule with a coaxial cable assembly for terminating an electrical connector comprising:

a cable having a cable shield, an inner jacket interior of the cable shield and an inner conductor interior of the inner jacket, an inner ferrule having an inner surface and an outer surface, the inner ferrule being conductive and providing electrical shielding;

an outer ferrule positioned radially outside of the inner ferrule such that the cable shield of the cable is received between the inner ferrule and the outer ferrule, the outer ferrule securing the cable shield between the inner ferrule and the outer ferrule; and an inner ferrule sleeve positioned radially inside of the inner ferrule, the inner ferrule sleeve having a bore extending between a front and a rear of the inner ferrule sleeve, the bore allowing the inner jacket and the inner conductor of the cable to pass freely therethrough, the inner ferrule sleeve substantially filling a space between the inner ferrule and the inner jacket of the cable, the inner ferrule sleeve being dielectric and electrically isolating the inner ferrule from the inner conductor of the cable.

2. The ferrule with a coaxial cable assembly of claim 1, wherein the inner ferrule sleeve includes an outer surface engaging the inner surface of the inner ferrule, the inner ferrule sleeve having an inner surface configured to directly engage the inner jacket of the cable.

3. The ferrule with a coaxial cable assembly of claim 2, wherein the inner ferrule sleeve includes interference bumps extending inward from the inner surface of the inner ferrule sleeve, the interference bumps configured to embed in the inner jacket of the cable.

4. The ferrule with a coaxial cable assembly of claim 1, wherein the inner ferrule sleeve includes a lip at a rear of the inner ferrule sleeve, the lip engaging a rear edge of the inner ferrule.

5. The ferrule with a coaxial cable assembly of claim 1, wherein the inner ferrule sleeve includes a seam extending lengthwise along the inner ferrule sleeve between the front and the rear of the inner ferrule sleeve, the seam allowing the inner ferrule sleeve to change diameter to fit in the inner ferrule.

6. The ferrule with a coaxial cable assembly of claim 1, wherein the inner ferrule sleeve blocks strands of the cable shield from passing between the inner ferrule and the inner jacket.

7. The ferrule with a coaxial cable assembly of claim 1, wherein the outer ferrule is crimped to the inner ferrule with the cable shield therebetween.

8. An electrical connector comprising:

a housing having a mating end configured to be mated with a mating connector and a housing cable end configured to be terminated to an end of a coaxial cable; and a ferrule assembly at the housing cable end configured to be coupled to the coaxial cable, the ferrule assembly comprising an inner ferrule, an inner ferrule sleeve inside the inner ferrule and an outer ferrule outside of the inner ferrule, the inner ferrule being conductive and providing electrical shielding, the inner ferrule having an inner surface and an outer surface with the outer ferrule positioned radially outside of the inner ferrule such that a cable shield of the coaxial cable is received between the inner ferrule and the outer ferrule, the outer ferrule securing the cable shield between the inner ferrule and the outer ferrule, the inner ferrule sleeve substantially filling the space between the inner ferrule and an inner jacket of the coaxial cable, the inner ferrule sleeve being dielectric and electrically isolating the inner ferrule from an inner conductor of the coaxial cable, the inner ferrule sleeve having a bore extending between a front and a rear of the inner ferrule sleeve, the bore allowing the inner jacket and the inner conductor of the coaxial cable to pass freely therethrough.

9. The electrical connector of claim 8, wherein the inner ferrule sleeve includes an outer surface engaging the inner surface of the inner ferrule, the inner ferrule sleeve having an inner surface configured to directly engage the inner jacket of the coaxial cable.

10. The electrical connector of claim 9, wherein the inner ferrule sleeve includes interference bumps extending inward from the inner surface of the inner ferrule sleeve, the interference bumps configured to embed in the inner jacket of the coaxial cable.

11. The electrical connector of claim 8, wherein the inner ferrule sleeve includes a lip at a rear of the inner ferrule sleeve, the lip engaging a rear edge of the inner ferrule.

12. The electrical connector of claim 8, wherein the inner ferrule sleeve includes a seam extending lengthwise along the inner ferrule sleeve between the front and the rear of the inner ferrule sleeve, the seam allowing the inner ferrule sleeve to change diameter to fit in the inner ferrule.

13. The electrical connector of claim 8, wherein the inner ferrule sleeve blocks strands of the cable shield from passing between the inner ferrule and the inner jacket.

14. The electrical connector of claim 8, wherein the outer ferrule is crimped to the inner ferrule with the cable shield therebetween.

15. An electrical connector comprising:

a coaxial cable having an end, the coaxial cable having an inner conductor, an inner jacket surrounding the inner conductor, a cable shield surrounding the inner jacket and a cable jacket surrounding the cable shield;

a housing having a mating end configured to be mated with a mating connector and a housing cable end terminated to the end of the coaxial cable, the housing holding a terminal terminated to the inner conductor, the housing having a shield electrically connected to the cable shield; and a ferrule assembly at the cable end coupling the shield to the cable shield of the coaxial cable, the ferrule assembly comprising an inner ferrule, an inner ferrule sleeve inside the inner ferrule and an outer ferrule outside of the inner ferrule, the inner ferrule being conductive and being electrically connected to the shield to provide electrical shielding, the inner ferrule having an inner surface and an outer surface with the outer ferrule positioned radially outside of the inner ferrule such that the cable shield of the coaxial cable is received between the inner ferrule and the outer ferrule, the outer ferrule securing the cable shield between the inner ferrule and the outer ferrule, the inner ferrule sleeve having a bore extending between a front and a rear of the inner ferrule sleeve, the bore allowing the inner jacket and the inner conductor of the coaxial cable to pass freely therethrough, the inner ferrule sleeve substantially filling the space between the inner ferrule and the inner jacket of the coaxial cable, the inner ferrule sleeve being dielectric and electrically isolating the inner ferrule from the inner conductor of the coaxial cable.

16. The electrical connector of claim 15, wherein the inner ferrule sleeve includes an outer surface engaging the inner surface of the inner ferrule, the inner ferrule sleeve having an inner surface configured to directly engage the inner jacket of the coaxial cable.

17. The electrical connector of claim 16, wherein the inner ferrule sleeve includes interference bumps extending inward from the inner surface of the inner ferrule sleeve, the interference bumps configured to embed in the inner jacket of the coaxial cable.

18. The electrical connector of claim 15, wherein the inner ferrule sleeve includes a lip at a rear of the inner ferrule sleeve, the lip engaging a rear edge of the inner ferrule.

19. The electrical connector of claim 15, wherein the inner ferrule sleeve includes a seam extending lengthwise along the inner ferrule sleeve between the front and the rear of the inner ferrule sleeve, the seam allowing the inner ferrule sleeve to change diameter to fit in the inner ferrule.

20. The electrical connector of claim 15, wherein the inner ferrule sleeve blocks strands of the cable shield from passing between the inner ferrule and the inner jacket.

* * * * *